US008434464B1

(12) United States Patent
Terzo

(10) Patent No.: US 8,434,464 B1
(45) Date of Patent: May 7, 2013

(54) ARROW REST FOR AN ARCHERY BOW

(76) Inventor: Michael B. Terzo, Missoula, MT (US)

( * ) Notice: Subject to any disclaimer, the term of this patent is extended or adjusted under 35 U.S.C. 154(b) by 655 days.

(21) Appl. No.: 12/645,735

(22) Filed: Dec. 23, 2009

Related U.S. Application Data

(60) Provisional application No. 61/140,231, filed on Dec. 23, 2008.

(51) Int. Cl.
*F41B 5/22* (2006.01)

(52) U.S. Cl.
USPC ..... 124/44.5

(58) Field of Classification Search ..... 124/44.5
See application file for complete search history.

(56) References Cited

U.S. PATENT DOCUMENTS

| | | | | |
|---|---|---|---|---|
| 4,949,699 | A | 8/1990 | Gerber | |
| 6,089,216 | A * | 7/2000 | Harwath et al. | 124/44.5 |
| 6,102,020 | A * | 8/2000 | Mizek et al. | 124/44.5 |
| 6,561,174 | B1 | 5/2003 | Afshari | |
| 6,948,488 | B2 | 9/2005 | Afshari | |
| 7,219,662 | B1 | 5/2007 | Henry | |
| 7,331,338 | B2 | 2/2008 | Mizek | |
| 7,409,950 | B2 | 8/2008 | Ellig et al. | |
| 2003/0136393 | A1 | 7/2003 | Barner et al. | |
| 2003/0192520 | A1 * | 10/2003 | Afshari | 124/35.2 |
| 2006/0162709 | A1 | 7/2006 | Roberts et al. | |

* cited by examiner

*Primary Examiner* — Gene Kim
*Assistant Examiner* — Amir Klayman

(57) ABSTRACT

An arrow rest for supporting an arrow with respect to an archery bow having a string assembly that includes a bow string. The arrow rest includes a pair of arms, a drive mechanism and a release mechanism. The pair of arms is moveable in unison between a raised position, wherein the arms are adapted to support the arrow, and a lowered position, wherein the arms are adapted to release the arrow. The drive mechanism is operable to selectively bias the pair of arms toward the lowered position. The drive mechanism is operatively connected to the string assembly of the bow, wherein release of the bow string from a drawn position causes the drive mechanism to move the arms from the raised position to the lowered position. The return mechanism is operable to move the arms from the lowered position to the raised position subsequent to movement of the arms from the raised position to the lowered position by the drive mechanism.

6 Claims, 6 Drawing Sheets

ARROW REST FOR AN ARCHERY BOW

CROSS-REFERENCE TO RELATED APPLICATIONS

This application claims the benefit of U.S. Provisional Patent Application Ser. No. 61/140,231, filed on Dec. 23, 2008.

FIELD OF THE INVENTION

The present invention relates to the field of arrow rests for archery bows, and more particularly, the present invention relates to an arrow rest that moves away from an arrow in response to release of the arrow and immediately returns to a ready position subsequent to release of the arrow.

BACKGROUND OF THE INVENTION

Arrow rests for archery bows are well known. Generally stated, arrow rests are structures that are adapted to support a fore portion of the arrow while an archer draws the bow, prior to releasing the arrow. In their most simple forms, arrow rests comprise a static structure that engages a portion of the arrow. However, such structures may interfere with the flight of the arrow as it is first released from the bow, by engaging the shaft or the fletching of the arrow.

In order to minimize the chance of interference, it is known to provide arrow rests having a shallow, V-shaped member that engages only a small portion of the bottom of the shaft of the arrow. However, since such arrow rests lack structure that significantly restrains lateral movement of the arrow with respect to the arrow rest, the arrow may become dislodged from the arrow rest as the archer draws the bow, prior to the release of the arrow.

A number of designs have attempted to remedy the deficiencies of static arrow rests. These devices generally fall into two categories. The first category includes fork-like arrow rests that receive the shaft of the arrow between a pair of spaced arms. The spaced arms move in unison, typically by pivoting forward to drop away from the arrow at the time that the arrow is fired, to provide a substantially unobstructed flight path for the arrow. The second category of devices includes arrow rests having a pair of arms that are pivotally mounted with respect to one another along a pivot axis that is roughly aligned with the arrow shaft, such that the arrow is received between the arms, and the arms pivot away from one another at the time that the arrow is fired. With respect to both categories of devices, the movement of the arrow rest away from the arrow is typically actuated either by contact of the arrow with the arrow rest, by manual operation of a trigger at the time that the arrow is released, or by connection of a portion of the arrow rest to a bow string or a related component of the archery bow. After firing, these devices require that the arrow rest be cocked, that is, moved to a ready position such that another arrow may be received on the arrow rest.

It would be desirable to have an arrow rest that completely removes itself from the path of an arrow at the time that the arrow is released without the need for manual actuation of the arrow rest. It would further be desirable to have an arrow rest that moved itself to a ready position subsequent to passage of the arrow, to eliminate the need for cocking the arrow rest.

SUMMARY OF THE INVENTION

The present invention relates to an arrow rest for supporting an arrow with respect to an archery bow having a string assembly that includes a bow string. The arrow rest includes a pair of arms, a drive mechanism and a release mechanism. The pair of arms is moveable in unison between a raised position, wherein the arms are adapted to support the arrow, and a lowered position, wherein the arms are adapted to release the arrow. The drive mechanism is operable to selectively bias the pair of arms toward the lowered position. In particular, the drive mechanism is operatively connected to the string assembly of the bow, wherein release of the bow string from a drawn position causes the drive mechanism to move the arms from the raised position to the lowered position. The return mechanism is operable to move the arms from the lowered position to the raised position subsequent to movement of the arms from the raised position to the lowered position by the drive mechanism.

The drive mechanism may have a disengaged position, wherein the drive mechanism does not bias the arms, and an engaged position, wherein the drive mechanism biases the arms toward the lowered position. Furthermore, movement of the bow string to the drawn position may move the drive mechanism from the disengaged position to the engaged position. In addition, movement of the arms to the lowered position may move the drive mechanism from the engaged position to the disengaged position.

The return mechanism may be configured to move the arms from the lowered position to the raised position upon movement of the drive mechanism to the disengaged position when the arms are in the lowered position. In particular, the return mechanism may apply a return force to the arms that is opposite in direction and smaller in magnitude than a drive force that is applied to the arms by the drive mechanism.

The arms may be further moveable with respect to one another between a closed position and an open position. In addition, the arrow rest may include a guide structure that engages the pair of arms to move the pair of arms from the closed position to the open position in response to movement of the arms from the raised position to the lowered position. The guide structure may be further operable to move the arms from the open position to the closed position in response to movement of the arms from the lowered position to the raised position.

The arrow rest may also include a main body that is mountable to the archery bow such that the main body is restrained against rotation with respect to the archery bow. The main body has a circumferential wall that extends along a longitudinal axis of the main body, wherein the spreader structure includes a pair of guide tracks that extend through the circumferential wall. The drive mechanism may include a drive member that is mounted to the main body for rotation with respect to the main body, a first biasing element that biases the drive member in a first direction, a cord that having a first end connected to the drive member and a second end that is connectable to the drawstring of the bow to rotate the drive member in response to movement of the drawstring of the bow, and a clutch member that selectively engages and disengages the drive member with respect to the pair of arms to move the drive mechanism between the engaged and disengaged positions. The drive member may include a spring steel tab that is selectively engageable with the pair of arms. The clutch member may include a ramp surface formed on the main body that is engageable with the spring steel tab to deflect the spring steel tab away from the pair of arms to thereby disengage the drive member from the pair of arms when the pair of arms reaches the lowered position.

BRIEF DESCRIPTION OF THE DRAWINGS

The description herein makes reference to the accompanying drawings wherein like referenced numerals refer to like parts throughout several views and wherein.

DETAILED DESCRIPTION OF THE PREFERRED EMBODIMENT

Figure 1:
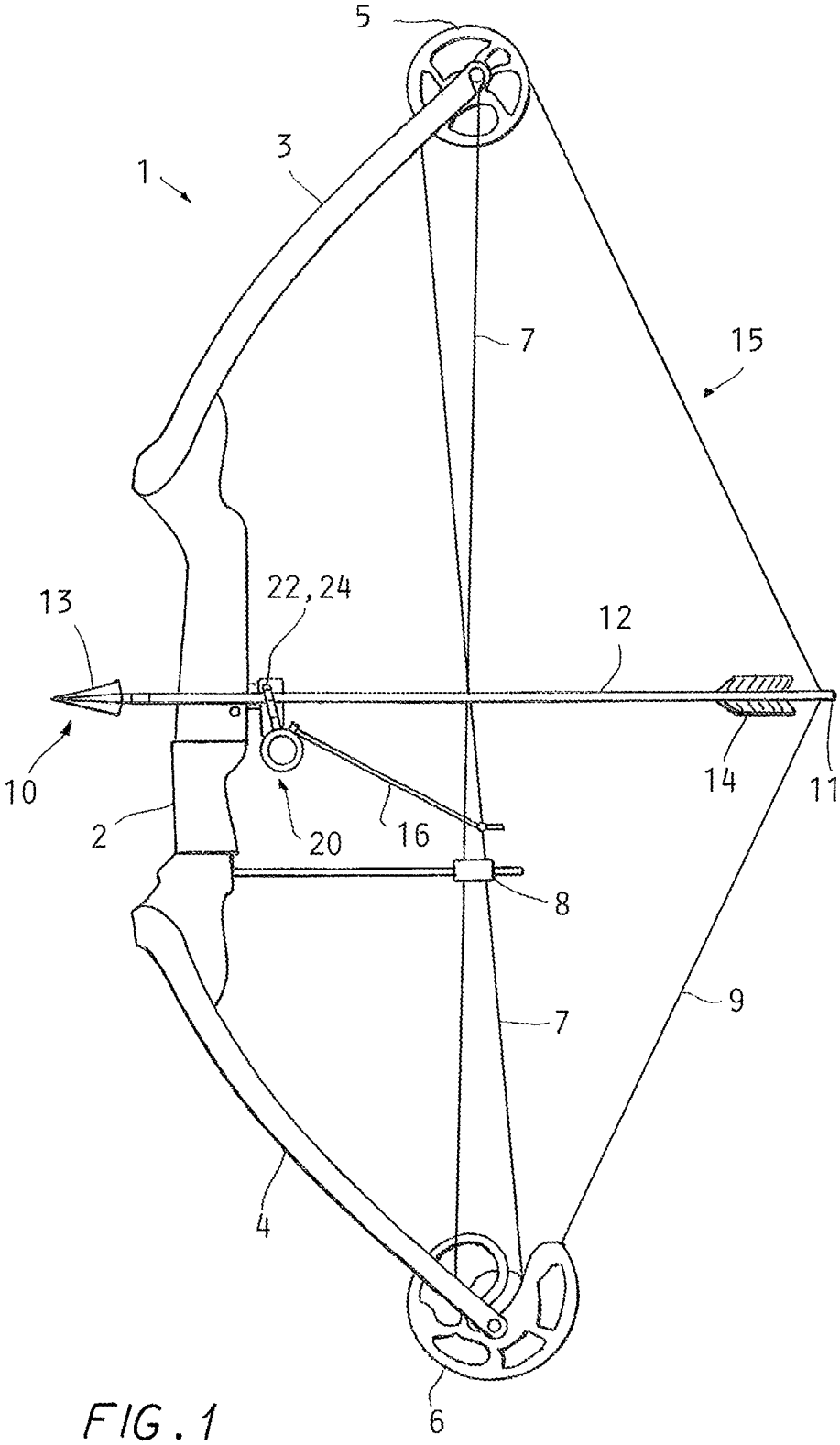
FIG. 1 is a side view of a compound bow having an arrow rest according to the present invention mounted thereto.

Referring to the drawings, the present invention will now be described in detail with reference to the disclosed embodiment.

FIG. 1 shows an arrow rest 20 according to the present invention mounted on a compound bow 1. When an arrow 10 is fired using the compound bow 1, motion of a string assembly 15 of the compound bow 1 is utilized to move a pair of first and second arms 22, 24, respectively, of the arrow rest 20 between a raised position, wherein the arms 22, 24 are adapted to support the arrow 10, and a lowered position, wherein the arms 22, 24 are adapted to release the arrow 10.

The compound bow 1 is conventional and may include a central body portion 2 having an upper limb 3 and a lower limb 4 connected thereto. An upper cam 5 is connected to the upper limb 3, while a lower cam 6 is connected to the lower limb 4.

In order to impart motion to the arrow 10, the string assembly 15 of the compound bow 1 includes a pair of buss cables 7 and a bow string 9. The buss cables 7 each extend between the upper cam 5 and the lower cam 6 and are each threaded through a cable slide 8 that is positioned between the upper cam 5 and the lower cam 6 of the compound bow 1. The bow string 9 is also connected to the upper cam 5 and the lower cam 6 of the compound bow 1 and is engageable with a nock 11 of the arrow 10. The arrow 10 is also conventional and includes a shaft 12, an arrow head 13, and fletching 14.

Figure 2:
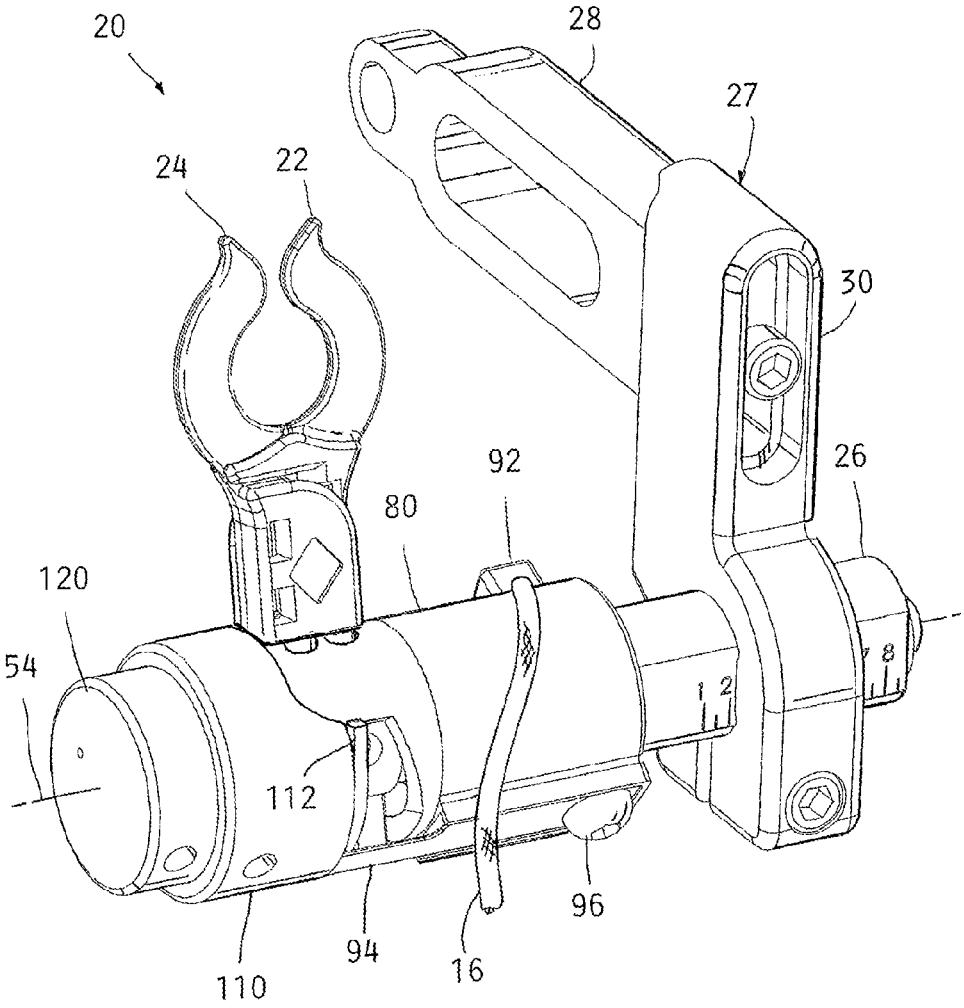
FIG. 2 is a perspective view of the arrow rest according to the present invention.

As shown in FIG. 2, the arrow rest 20 includes, as its main portions, the pair of arms 22, 24, a main body 26, a drive member 80, a clutch collar 110, and an end cap 120. A cord 16 is provided to connect the drive member 80 to the string assembly 15 of the compound bow 1. A two part mounting structure 27 is provided to connect the arrow rest 120 to the central body portion 2 of the compound bow 1.

In order to position the arrow rest 20 with respect to the compound bow 1 so that the arms 22, 24 of the arrow rest 20 can support the shaft 12 of the arrow 10, the two part mounting structure 27 includes an upper mounting member 28 that is adjustably connected to a lower mounting member 30. The upper mounting member 28 is connectable to the central body portion 2 of the compound bow 1 in a conventional manner such that movement of the upper mounting member 28 relative to the central body portion 2 of the compound bow 1 is restrained.

Figure 3:
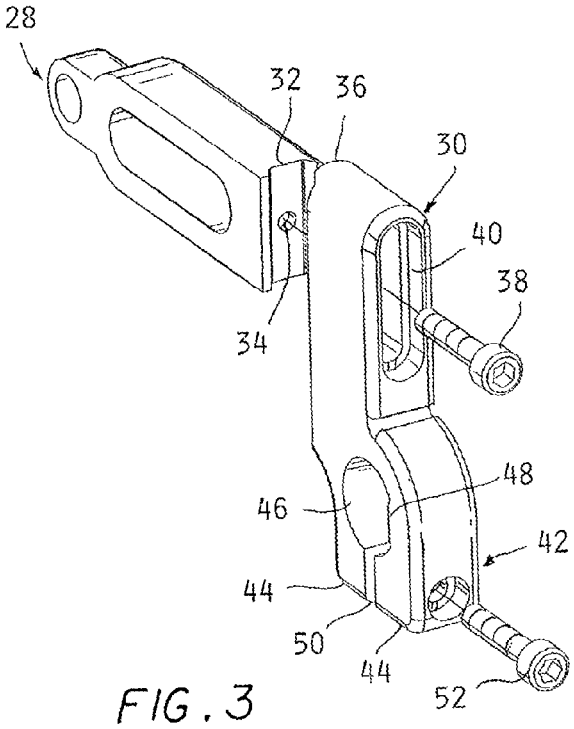
FIG. 3 is a perspective view showing an upper mounting member and a lower mounting member of the arrow rest according to the present invention.

To allow elevational adjustment of the lower mounting member 30 with respect to the upper mounting member 28 of the two-part mounting structure 27, a contoured end surface 32 and an aperture 34 are provided on the upper mounting member 28 for engagement with a contoured surface 36 of the lower mounting member 30 and a fastener 38, as best seen in FIG. 3. The contoured surfaces 32, 36 facilitate a controlled sliding motion between the upper mounting member 28 and the lower mounting member 30. The fastener 38 is received in an elongate slot 40 in the lower mounting member 30 for engagement with the aperture 34 of the upper mounting member 28 and may be tightened with respect to the elongate slot 40 to secure the lower mounting member 30 at a desired position with respect to the upper mounting member 28.

In order to secure the main body 26 of the arrow rest 20 to the lower mounting member 30, a clamping structure 42 is formed on the lower mounting member 30. The clamping structure 42 is provided by a pair of furcations 44 that cooperate to define a bore 46 having at least one alignment feature, such as a substantially planar surface 48 and a gap 50 that is defined between the furcations 44 adjacent to the bore 46. The gap 50 is bridged by a fastener 52 that engages both of the furcations 44 to move the clamping structure 42 between a clamped position, wherein the main body 26 of the arrow rest 20 is restrained against moving relative to the lower mounting member 30, and an unclamped position, wherein the furcations 44 no longer engage the main body 26 of the arrow rest 20 with sufficient force to prevent relative motion of the main body 26 with respect to the lower mounting member 30.

Figure 4:
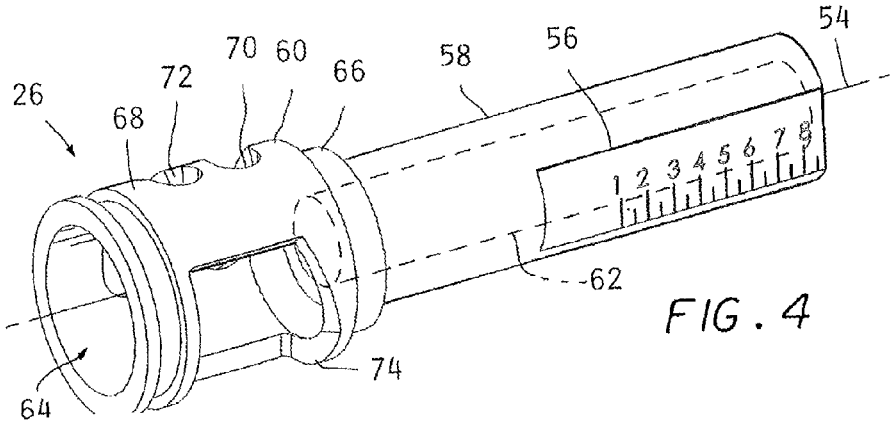
FIG. 4 is a perspective view of a main body of the arrow rest according to the present invention.

To provide a substantially fixed structure that supports, and in part defines, the operational components of the arrow rest 20, the main body 26 provides a substantially rigid structure that extends along a longitudinal axis 54, as shown in FIG. 4. The main body 26 has two main portions, namely a substantially tubular portion 58 and a hollow, substantially cylindrical portion 60 that is formed integrally with the tubular portion 58. The cylindrical portion 60 of the main body 26 is adjacent to the tubular portion 58, and both the tubular portion 58 and the cylindrical portion 60 are aligned along the longitudinal axis 54 of the main body 26. The tubular portion 58 is elongate, having a length greater than that of the cylindrical portion 60. The cylindrical portion 60 has a larger diameter than the tubular portion 58, resulting in a stepped diameter portion 66 that is formed on the exterior of the main body 26 where the tubular portion 58 meets the cylindrical portion 60. The tubular portion 58 of the main body 26 is substantially hollow, having a longitudinal bore 62 extending therethrough. The longitudinal bore 62 of the tubular portion 58 is in communication with a hollow interior 64 of the cylindrical portion 60 of the main body 26.

In order to connect the main body 26 of the arrow rest 20 to the two-part mounting structure 27, the tubular portion 58 of the main body 26 is configured such that it is receivable within the bore 46 that is defined through the lower mounting structure 30. Thus, when assembled with respect to the lower mounting member 30, at least part of the tubular portion 58 of the main body 26 extends through the bore 46 of the lower mounting member 30. To restrain rotation of the main body 26 with respect to the lower mounting member 30 about the longitudinal axis 54 of the main body 26, an alignment feature, such as a substantially planar surface 56, is formed on the exterior of the tubular portion 58 of the main body 26 for engagement with a complementary portion of the lower mounting member 30, such as the substantially planar surface 48.

The cylindrical portion 60 of the main body 26 is defined primarily by a circumferential wall 68 that extends about the longitudinal axis 54 of the main body 26. A first guide track 70 and a second guide track 72 are formed through the circumferential wall 68 of the cylindrical portion 60. The first guide track 70 and the second guide track 72 are elongate apertures that extend through the circumferential wall 68 to guide motion of the first arm 22 and the second arm 24, as will be explained herein. A window-like opening 74 is formed through the circumferential wall 68 of the cylindrical portion 60 of the main body 26 opposite the first guide track 70 and the second guide track 72. The opening 74 extends both longitudinally and circumferentially to provide access into the hollow interior 64 of the cylindrical portion 60.

Figure 5:
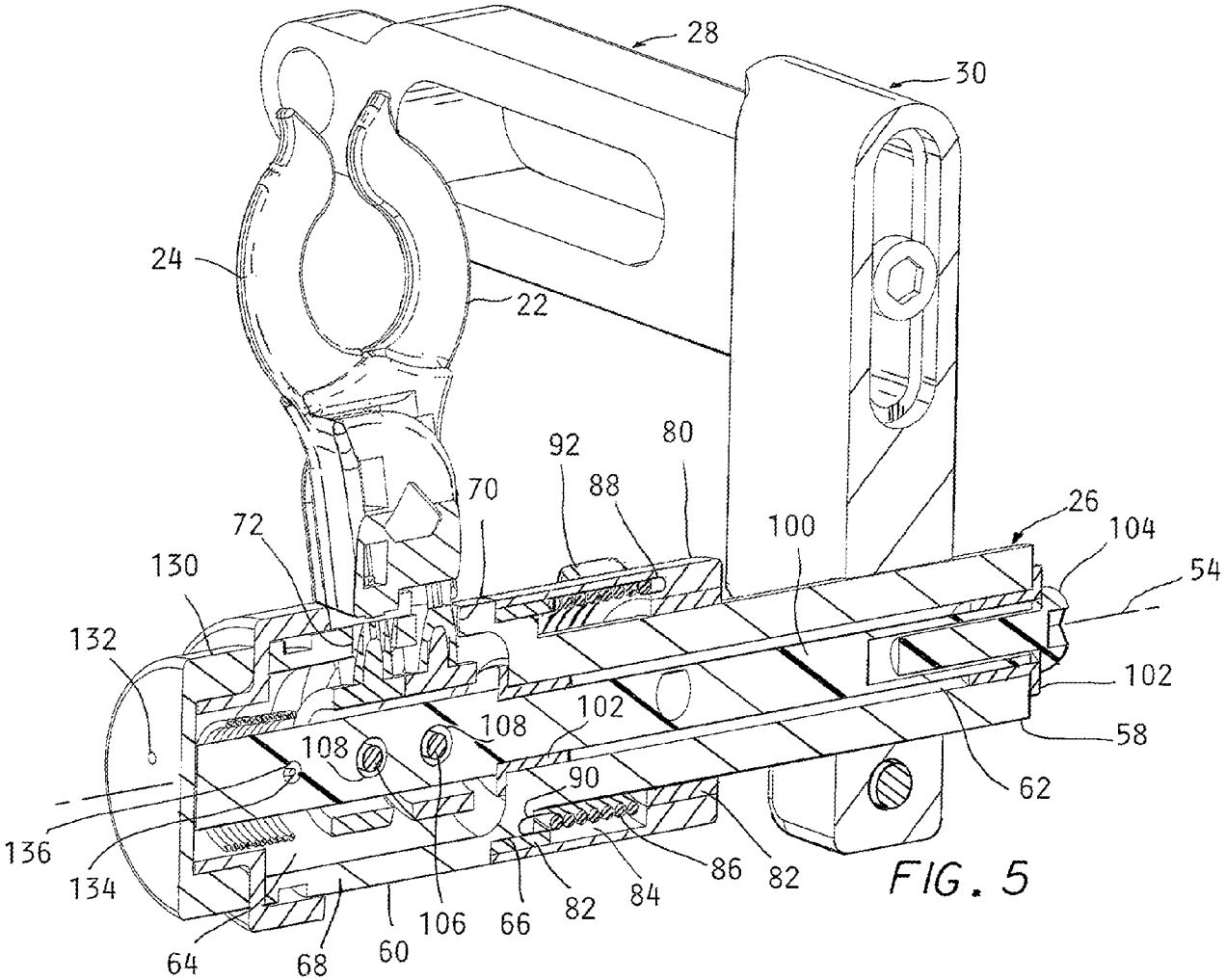
FIG. 5 is a cross-section view of the arrow rest according to the present invention.

In order to mount the pair of arms 22, 24 for rotation with respect to the main body 26, an axle 100 is disposed within the main body 26, as shown in FIG. 5. The axle 100 extends along the longitudinal axis 54 of the main body 26 and extends through the longitudinal bore 62 of the tubular portion 58, as well as through the hollow interior 64 of the cylindrical portion 60 of the main body 26. The axle 100 is supported for rotation with respect to the main body 26 by a pair of rimmed bushings 102 disposed at least partially within the longitudinal bore 62 of the tubular portion 58 at each end thereof. The axle 100 is secured in place with respect to the main body 26 by a fastener 104 located at an end of the axle 100.

Figure 6:
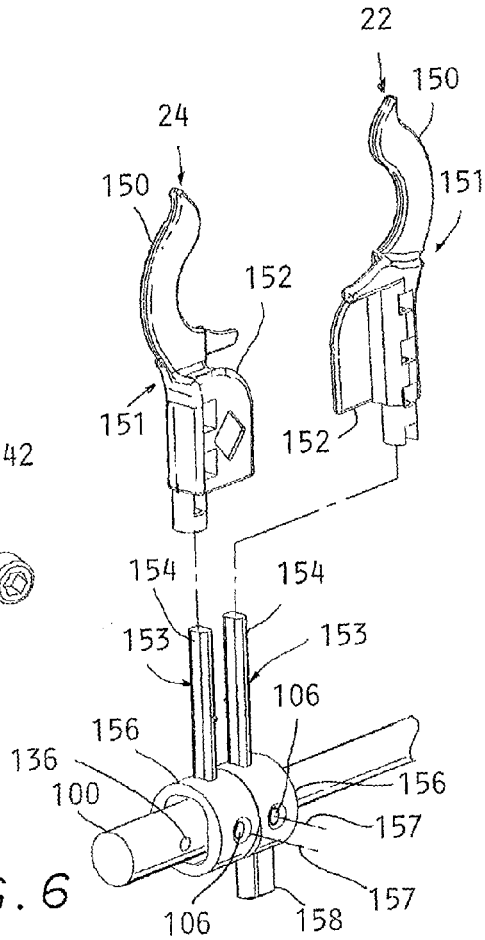
FIG. 6 is a detail view showing connection of a pair of arms to an axle of the arrow rest according to the present invention.

As best seen in FIG. 6, the pair of first and second arms 22, 24 each have a two-part structure having an arrow holder 151 and a base member 153. The arrow holder 151 of each of the arms 22, 24 includes an arcuate portion 150 in which the arrow 10 is receivable, and an interleaved portion 152. The base member 153 of each of the arms 22, 24 includes a post 154 and a mounting member 156. The interleaved portions 152 of the arrow holders 151 provide engagement between the first arm 22 and the second arm 22 adjacent to the arcuate portions 150 and external to the main body 26. The interleaved portions 152 engage one another to enforce uniform rotation of the pair of arms 22, 24. The post 154 of the base member 153 of each of the arms 22, 24 is receivable with the interleaved portion 152 of the arrow holder 151 of each of the arms 22, 24, and the posts 154 are each adapted to extend through a respective one of the guide tracks 70, 72 of the cylindrical portion 60 of the main body 26. The base member 153 of the first arm 22 further includes an extension 158 that extends outward from the mounting member 156 of the base member 153 of the first arm 22 opposite the post 154 thereof. The extension 158 is configured to extend out of the window-like opening 74 that is formed through the circumferential wall 68 of the cylindrical portion 60 of the main body 26.

In order to connect the arms 22, 24 to the axle 100, the mounting members 156 may be substantially tubular members that receive the axle 100. IN the alternative, other suitable connecting structures may be utilized to connect the arms 22, 24 to the axle 100. Within the hollow interior 64 of the cylindrical portion 60 of the main body 26, the first arm 22 and the second arm 24 are secured to the axle 100 by fasteners 106, such as pins, bolts, or screws that are connected to the mounting members 156 of the arms 22, 24 and extend through corresponding apertures 108 that extend transversely through the axle 100. The fasteners 106 allow the arms 22, 24 to pivot slightly with respect to the axle 100 about respective pivot axes 157 which are substantially transverse to the longitudinal axis 54 of the main body 26.

Figure 7A:
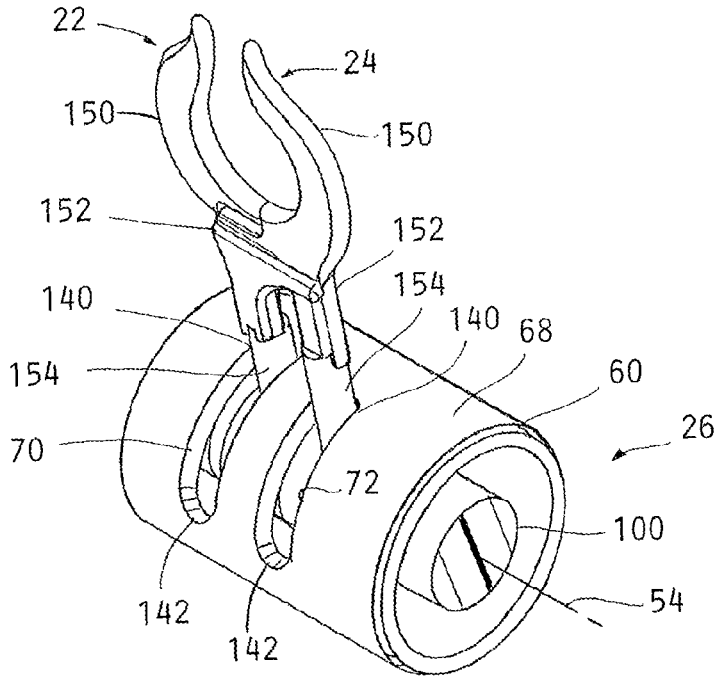
FIG. 7A is an illustration showing the pair of arms of the arrow rest of the present invention in a raised position.
Figure 7B:
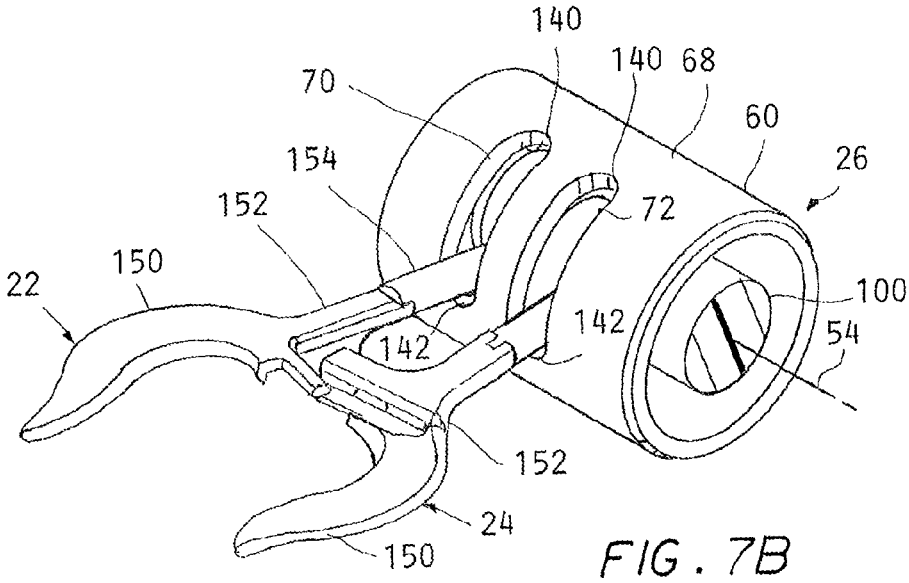
FIG. 7B is an illustration showing the pair of arms of the arrow rest according to the present invention in a lowered position.

As best seen in FIGS. 7A-7B, the guide tracks 70, 72 serve to control the motion of the first arm 22 and the second arm 24, as the first and second arms 22, 24 move between the raised position, as seen in FIG. 7A, and the lowered position, as seen in FIG. 7B. In particular, the first guide track 70 and the second guide track 72 each extend circumferentially around a portion of the circumferential wall 68 of the cylindrical portion 60 of the main body 26 from a first end 140 to a second end 142. Accordingly, the first guide track 70 and the second guide track 72 are spaced from one another by a portion of the circumferential wall 68 of the cylindrical portion 60 of the main body 26. However, the spacing between the first guide track 70 and the second guide track 72 is variable, in that a first, narrow spacing is defined between the first guide track 70 and the second guide track 72 at the first ends 140 thereof, and a second, wider spacing is defined between the first guide track 70 and the second guide track 72 at the lower ends 142 thereof. The variation in spacing is provided either by curves in the guide tracks 70, 72 or by orienting the guide tracks 70, 72 other than perpendicularly with respect to the longitudinal axis 54 of the main body 26.

When the arms 22, 24 rotate about the longitudinal axis 54 of the main body 26, the first ends 140 and the second ends 142 of the first and second guide tracks 70, 72 serve as mechanical stops that define the maximum range of travel of the pair of arms 22, 24. For example, when the posts 154 of the arms 22, 24 are engaged with the first ends 140 of the guide tracks 70, 72, the arms 22, 24 are in the raised position. When the arms 22, 24 are in the lowered position, the posts 154 of the first arm 22 and the second arm 24 are spaced from the first ends 140 of the first guide track 70 and the second guide track 72 and may be engaged with the second ends 142 of the first guide track 70 and the second guide track 72.

The guide tracks 70, 72 also dictate the degree to which the first arm 22 and the second arm 24 are pivoted with respect to one another about their respective pivot axes, by acting as a guide structure that laterally deflects the arms 22, 24, as the arms 22, 24 rotate between the raised position and the lowered position. In particular, due to the widened spacing between the first guide track 70 and the second guide track 72 at the second ends 142 thereof as compared to the first ends 140 thereof, the first arm 22 and the second arm 24 pivot away from one another in response to movement of the pair of arms 22, 24 from the raised position to the lowered position. Conversely, when the pair of arms 22, 24 are returned to the raised position from the lowered position, the guide tracks 70, 72 cause the first arm 22 and the second arm 24 to pivot back toward one another, as the pair of arms 22, 24 approaches the first end 140 of each of the first guide track 70 and the second guide track 72.

Due to the pivotal motion of the pair of arms 22, 24 with respect to each other in response to movement between the raised and lowered positions, the pair of arms 22, 24 defines a closed position that corresponds to the raised position and an open position that corresponds to the lowered position. However, it should be understood that the guide tracks 70, 72 may be configured such that the pair of arms 22, 24 reaches the open position prior to reaching the lowered position at an intermediate location along the guide tracks 70, 72 between the first ends 140 and the second ends 142 thereof. It should also be understood that other structures could act as guide surfaces to direct the arms 22, 24, as the arms 22, 24 rotate between the raised and lowered positions. For example, the window-like aperture 74 of the cylindrical portion 60 of the main body 26 could define guide surfaces that engage the arms 22, 24 to laterally deflect the arms 22, 24 in the same manner as described in connection with the guide tracks 70, 72.

Movement of the pair of arms 22, 24 from the raised position to the lowered position is governed by a drive mechanism that includes the drive member 80, a spring steel tab 84, a drive spring 86, the clutch collar 110 and the cord 16. Referring back to FIGS. 2 and 5, the drive member 80 is a thin-walled, substantially tubular structure that is seated on the tubular portion 58 of the main body 26 between the stepped portion 66 of the main body 26 and the lower mounting member 30. The drive member 80 is separated from the main body 26 by a pair of bushings 82 that facilitate rotation of the drive member 80 about the longitudinal axis 54 of the main body 26.

In order to rotationally bias the drive member 80 with respect to the main body 26, a drive spring 86 is disposed within a circumferential cavity 84 that is formed between the tubular portion 58 of the main body 26 and the drive member 80 and defined in part by the bushings 82, which space portions of the drive member 80 from the tubular portion 58 of the main body 26. A first end 88 of the drive spring 86 is engaged with the drive member 80, while a second end 90 of the drive spring 86 is engaged with the main body 26. The drive spring 86 is a torsion spring that rotationally biases the drive member 80 for rotation in a direction corresponding to movement of the arms 22, 24 from the raised position to the lowered position. The biasing force applied to the drive member 80 by the drive spring 86 is greater than the biasing force applied to the arms 22, 24 by the return spring 130.

The drive member 80 is adapted to receive an actuating force from the string assembly 15 by way of the cord 16. In order to connect the cord 16 to the drive member 80, a mounting member 92 is provided on the exterior of the drive member 80. The cord 16 is tied or otherwise secured to the drive member 80 and is also tied to a portion of the string assembly 15 of the compound bow 1, such as to one of the buss cables 7. The actuating force applied by the cord 16 to the drive member 80 is operable to cause rotation of the drive member 80 in a direction opposite the force applied by the drive spring 86.

The drive member 80 defines or is connected to a structure that is adapted to impart motion from the drive member 80 to the first arm 22 and the second arm 24, such as the spring steel tab 94. The spring steel tab 94 is an elongate, flexible member that is connected to the drive member 80 by a fastener, such as a screw 96. The spring steel tab 94 is provided on the exterior of the drive member 80 circumferentially opposite the mounting member 92, and extends longitudinally outward from the drive member 80, such that it at least partially overlies the window-like opening 74 that is formed through the circumferential wall 68 of the cylindrical portion 60 of the main body 26. In this manner, the spring steel tab 94 is engageable with the extension 158 of the first arm 22. Because the first arm 22 and the second arm 24 are both connected to the axle 100 for uniform rotation, engagement of the spring steel tab 94 with the extension 158 of the first arm 22 is operable to impart a rotational force to both the first arm 22 and the second arm 24.

In order to provide selective engagement and disengagement of the spring steel tab 94 with the pair of arms 22, 24, the clutch collar 110 is connected to the cylindrical portion 60 of the main body 26, opposite the drive member 80, as seen in FIG. 2. A ramp surface 112 is formed on the clutch collar 110 and extends circumferentially around a portion of the clutch collar 110. The ramp surface 112 is engageable with the spring steel tab 94 and has a profile configured to deflect the spring steel tab 94 radially outward from the main body 26 as the drive member 80 rotates with respect to the main body 26. Outward deflection of the spring steel tab 94 by the ramp surface 112 allows selective disengagement of the spring steel tab 94 from the pair of arms 22, 24.

Movement of the pair of arms 22, 24 from the lowered position to the raised position is governed by a return mechanism that includes the end cap 120 and a return spring 130. The end cap 120 is connected to the clutch collar 110 opposite the cylindrical portion 160 of the main body 26. Both the clutch collar 110 and the end cap 120 are configured to remain rotationally fixed with respect to the main body 26 during movement of the pair of arms 22, 24 with respect to the main body 26.

In order to apply a constant biasing force to the pair of arms 22, 24, the return spring 130 is disposed at least partially within the hollow interior 64 of the cylindrical portion 60 of the main body 26 and/or the clutch collar 110. The return spring 130 is a torsion spring having a first leg 132 that is engaged with the cap 120 and a second leg 134 that applies torque to the pair of arms 22, 24, such as by disposing the second leg 134 within a transverse aperture 136 that is formed through the axle 100, or by direct engagement of the return spring 130 with the arms 22, 24. The return spring 130 provides a constant rotational biasing force to the pair of arms 22, 24 that biases the pair of arms 22, 24 toward the raised position.

Figure 8A:
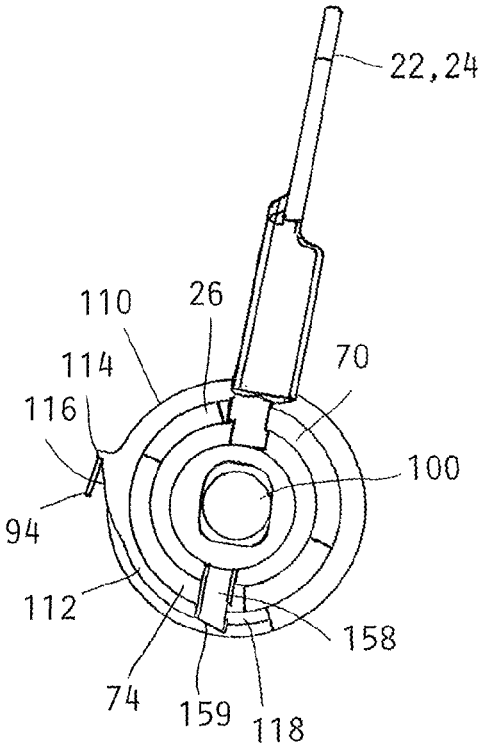
FIG. 8A is a cross-section showing a drive mechanism of the arrow rest according to the present invention in a disengaged position.

Operation of the arrow rest 20 will now be explained with reference to FIGS. 7A-7B and 8A-8C. Initially, the arrow rest 20 is installed with respect to the compound bow 1, and the bow string 9 of the string assembly 15 is not deflected from its rest position such that it extends directly between the upper cam 5 and the lower cam 6 of the compound bow 1 in a straight line. At this point, the arms 22, 24 are in their raised position and consequently also in their closed position due to the biasing force applied to the arms 22, 24 by the return spring 130, as shown in FIGS. 7A and 8A. The drive member 80 is in a disengaged position, wherein the spring steel tab 94 engages a lip 114 at a diametrically widened end 116 of the ramp surface 112. In particular, the biasing force applied to the drive member 80 by the drive spring 88 holds the spring steel tab 94 in engagement with the lip 114, and this engagement prevents further rotation of the drive member 80. Finally, while the arms 22, 24 are in their raised position, the extension 158 of the first arm 22 is disposed adjacent to a diametrically-narrowed end 118 of the ramp surface 112 opposite the diametrically widened end 116.

Figure 8B:
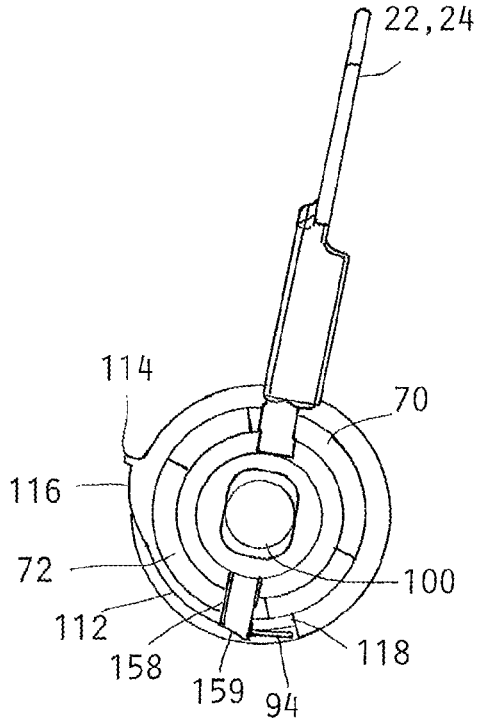
FIG. 8B is a cross-section showing the drive mechanism of the arrow rest according to the present invention in an engaged position prior to release of a bow string of the compound bow from a drawn position.

When the user engages the arrow 10 with the bow string 9 of the string assembly 15 of the compound bow 1, the buss cables 7 are drawn upward or downward between the upper cam 5 and the lower cam 6. Because the cord 16 is tied to one of the buss cables 7, the sliding motion of the buss cables 7 is transmitted to the drive member 80 of the arrow rest 20 by the cord 16 and causes rotation of the drive member 80. In particular, the drive member 80 rotates against the biasing force applied by the drive spring 86, such that the spring steel tab 94 of the drive member 80 moves from the widened end 116 of the ramp surface 112 toward the narrowed end 118 of the ramp surface 112. As it does so, the spring steel tab 94 engages an inclined end surface 159 of the extension 158 of the first arm 22. Engagement of the spring steel tab 94 with the inclined end surface 159 causes outward deflection of the spring steel tab 94 so that the spring steel tab 94 may move rotationally past the extension 158 of the first arm 22. Upon doing so, the drive member 80 reaches an engaged position, as shown in FIG. 8B, wherein the spring steel tab 94 is disposed at the narrowed end 118 of the ramp surface and is engageable with the extension 158 of the first arm 22 for rotating the pair of arms 22, 24 toward the lowered position.

Figure 8C:
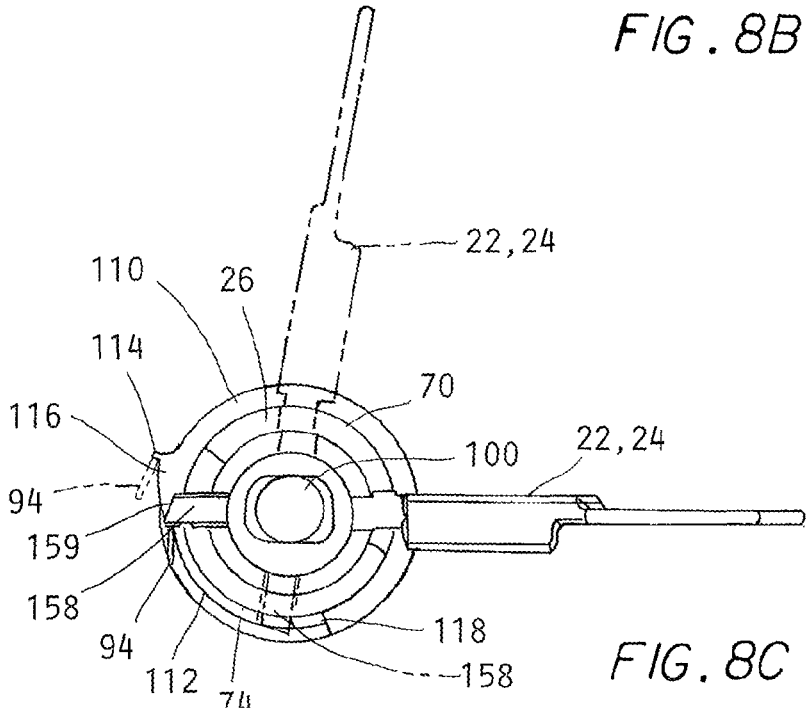
FIG. 8C is a cross-section showing the driving mechanism of the arrow rest according to the present invention in an engaged position while the pair of arms is moving from the raised position to the lowered position.

When the user of the compound bow 1 releases the arrow 10, the bow string 9 is released from the drawn position, and a sliding motion of the buss cable 7 allows the drive member 80 to rotate in the direction of the biasing force supplied thereto by the drive spring 86. As it does so, the spring steel tab 94 is engaged with the extension 158 of the first arm 22 and drives the arms 22, 24 from the raised position to the lowered position. As the arms 22, 24 move toward their lowered position, the configuration of the first guide track 70 and the second guide track 72 pivots the arms 22, 24 from the closed position to the open position. With the arms 22, 24 in both of the lowered and open positions, as shown in FIGS. 7B and 8C, the arrow 10 is able to move away from the compound bow 1 in response to the force applied thereto by the bow string 9 without being impeded by contact with the arms 22, 24.

As the arms 22, 24 approach their lowered position, the extension 158 of the first arm 22 is adjacent to the widened end 116 of the ramp surface 112. Thus, the spring steel tab 94 is deflected diametrically outward by the widened end 116 of the ramp surface 112. After the spring steel tab 94 is deflected outward past the inclined end surface 159 of the extension 158, the spring steel tab 94 disengages from the extension 158 and continues moving until the drive member 80 reaches its disengaged position, wherein the spring steel tab 94 is in engagement with the lip 114 on the clutch collar 110. Because the spring steel tab 94 is no longer engaged with the extension 158, the arms 22, 24 are no longer biased by the drive spring 86. Absent the rotational force that had previously been applied to the arms 22, 24 by drive spring 86 by way of the spring steel tab 94, the arms 22, 24 are now subject solely to the biasing force of the return spring 130. In response to the biasing force applied by the return spring 130, the arms 22, 24 return to their raised position, as shown by the phantom lines in FIG. 8C, and consequently return to their closed position.

While the invention has been described in connection with what is presently considered to be the most practical and preferred embodiment, it is to be understood that the invention is not to be limited to the disclosed embodiments, but to the contrary, it is intended to cover various modifications or equivalent arrangements included within the spirit and scope of the appended claims. The scope is to be accorded the broadest interpretation so as to encompass all such modifications and equivalent structures as is permitted under the law.

What is claimed is:

1. An arrow rest for supporting an arrow with respect to an archery bow having a string assembly that includes a bow string, the arrow rest comprising:

a pair of arms that are moveable in unison between a raised position, wherein the arms are adapted to support the arrow, and a lowered position, wherein the arms are adapted to release the arrow, the arms further moveable with respect to one another between a closed position and an open position;

a guide structure that engages the pair of arms to move the pair of arms from the closed position to the open position in response to movement of the arms from the raised position to the lowered position and further operable to move the arms from the open position to the closed position in response to movement of the arms from the lowered position to the raised position;

a main body that is mountable to the archery bow such that the main body is restrained against rotation with respect to the archery bow, the main body having a circumferential wall that extends along a longitudinal axis of the main body, wherein the guide structure includes a pair of guide tracks that extend through the circumferential wall, and the arms extend through the guide tracks;

a drive mechanism operable to selectively bias the pair of arms toward the lowered position, the drive mechanism operatively connected to the string assembly of the bow, wherein release of the bow string from a drawn position causes the drive mechanism to move the arms from the raised position to the lowered position, the drive mechanism including a drive member that is mounted to the main body for rotation with respect to the main body, a first biasing element that biases the drive member in a first direction, a cord having a first end connected to the drive member and a second end that is connectable to the string assembly of the bow to rotate the drive member in response to movement of the bow string of the bow, and a clutch member that selectively engages and disengages the drive member with respect to the pair of arms to move the drive mechanism between the engaged and disengaged position; wherein the clutch member includes a ramp surface that is engageable with the spring steel tab to deflect the spring steel tab away from the pair of arms to thereby disengage the drive member from the pair of arms when the pair of arms reaches the lowered position; and a return mechanism operable to move the arms from the lowered position to the raised position subsequent to movement of the arms from the raised position to the lowered position by the drive mechanism.

2. The arrow rest of claim 1, wherein the drive member includes a spring steel tab that is selectively engageable with the pair of arms.

3. An arrow rest for supporting an arrow with respect to an archery bow having a drawstring, the arrow rest comprising:

a pair of arms that are moveable in unison between a raised position, wherein the arms are adapted to support the arrow, and a lowered position, wherein the arms are adapted to release the arrow, the arms further moveable with respect to one another between a closed position and an open position;

a drive mechanism operable to selectively apply a drive force to the pair of arms to bias the pair of arms toward the lowered position, the drive mechanism having a disengaged position, wherein the drive mechanism does not bias the arms, and an engaged position, wherein the drive mechanism biases the arms toward the lowered position, the drive mechanism operatively connected to the string assembly of the bow, such that movement of the bow string to a drawn position moves the drive mechanism from the disengaged position to the engaged position, and further wherein release of the bow string from a drawn position causes the drive mechanism to move the arms to the lowered position and subsequently move the drive mechanism to the disengaged position, the drive mechanism including a drive member that is mounted to the main body for rotation with respect to the main body, a first biasing element that biases the drive member in a first direction, a cord that is connectable to the bow string of the bow, and a dutch member that selectively engages and disengages the drive member with respect to the pair of arms to move the drive mechanism between the engaged and disengaged position; wherein the clutch member includes a ramp surface that is engageable with the spring steel tab to deflect the spring steel tab away from the pair of arms to thereby disengage the drive member from the pair of arms when the pair of arms reaches the lowered position;

a return mechanism that applies a return force to the pair of arms that is opposite in direction and smaller in magnitude than the drive force to bias the pair of arms toward the raised position, such that the return mechanism is operable to move the arms from the lowered position to the raised position upon movement of the drive mechanism to the disengaged position when the arms are in the lowered position;

a guide structure that engages the pair of arms to move the pair of arms from the closed position to the open position in response to movement of the arms from the raised position to the lowered position and further operable to move the arms from the open position to the closed position in response to movement of the arms from the lowered position to the raised position; and a main body that is mountable to the archery bow such that the main body is restrained against rotation with respect to the archery bow, the main body having a circumferential wall that extends along a longitudinal axis of the main body, wherein the guide structure includes a pair of guide tracks that extend through the circumferential wall, and the arms extend through the guide tracks.

4. The arrow rest of claim 3, wherein the drive member includes a spring steel tab that is selectively engageable with the pair of arms.

5. An arrow rest for supporting an arrow with respect to an archery bow having a string assembly that includes a bow string, the arrow rest comprising:

a main body that is mountable to the archery bow such that the main body is restrained against rotation with respect to the archery bow, the main body having a circumferential wall that extends along a longitudinal axis of the main body;

a pair of arms that are mounted for rotation in unison about the longitudinal axis of the main body between a raised position, wherein the arms are adapted to support the arrow, and a lowered position, wherein the arms are adapted to release the arrow, the arms further pivotally moveable with respect to one another between a closed position and an open position;

a drive mechanism operable to selectively apply a drive force to the pair of arms to bias the pair of arms toward the lowered position, the drive mechanism having a disengaged position, wherein the drive mechanism does not bias the arms, and an engaged position, wherein the drive mechanism biases the arms toward the lowered position, the drive mechanism operatively connected to the string assembly of the bow, such that movement of the bow string to a drawn position moves the drive mechanism from the disengaged position to the engaged position, and further wherein release of the bow string causes the drive mechanism to move the arms to the lowered position and subsequently move the drive mechanism to the disengaged position, the drive mechanism including a drive member that is mounted to the main body for rotation with respect to the main body, a first biasing element that biases the drive member in a first direction, a cord that is connectable to the string assembly of the bow, and a clutch member that selectively engages and disengages the drive member with respect to the pair of arms to move the drive mechanism between the engaged and disengaged position; wherein the clutch member includes a ramp surface that is engageable with the spring steel tab to deflect the spring steel tab away from the pair of arms to thereby disengage the drive member from the pair of arms when the pair of arms reaches the lowered position;

a return mechanism that applies a return force to the pair of arms that is opposite in direction and smaller in magnitude than the drive force to bias the pair of arms toward the raised position, such that the return mechanism is operable to move the arms from the lowered position to the raised position upon movement of the drive mechanism to the disengaged position when the arms are in the lowered position; and a pair of guide tracks that extend through the circumferential wall and engage the pair of arms to move the pair of arms from the closed position to the open position in response to movement of the arms from the raised position to the lowered position and further operable to move the arms from the open position to the closed position in response to movement of the arms from the lowered position to the raised position.

6. The arrow rest of claim 5, wherein the drive member includes a spring steel tab that is selectively engageable with the pair of arms.

* * * * *